US005666997A

United States Patent [19]

Vinciguerra et al.

[11] Patent Number: 5,666,997

[45] Date of Patent: Sep. 16, 1997

[54] QUICK COUPLING SYSTEM FOR THE HEALD FRAMES OF A LOOM

[75] Inventors: Costantino Vinciguerra; Alessandro Galanti, both of Firenze, Italy

[73] Assignee: Nuovo Pignone S.p.A., Firenze, Italy

[21] Appl. No.: 516,812

[22] Filed: Aug. 18, 1995

[30] Foreign Application Priority Data

Aug. 30, 1994 [IT] Italy ..... MI94A1788

[51] Int. Cl.[6] ..... D03C 9/00

[52] U.S. Cl. ..... 139/57; 403/291

[58] Field of Search ..... 403/291; 139/57

[56] References Cited

U.S. PATENT DOCUMENTS

| | | | |
|---|---|---|---|
| 3,186,440 | 6/1965 | League . | |
| 3,696,842 | 10/1972 | Pfarrwaller . | |
| 3,888,284 | 6/1975 | Tiernan et al. | 139/57 |
| 5,002,096 | 3/1991 | Bucher et al. | 139/57 |
| 5,050,644 | 9/1991 | Peter . | |
| 5,348,053 | 9/1994 | Oertli | 139/57 |
| 5,483,995 | 1/1996 | Oertli | 139/57 |

FOREIGN PATENT DOCUMENTS

| | | |
|---|---|---|
| 1 152 669 | 8/1963 | Germany . |
| 0 598 161 A1 | 4/1994 | Germany . |
| 608040 | 12/1978 | Switzerland . |

*Primary Examiner*—Andy Falik

*Attorney, Agent, or Firm*—George P. Hoare, Jr.; Rogers & Wells

[57] ABSTRACT

An apparatus for rapidly and simultaneously, coupling and uncoupling loom heald frames, of varying length, to and from their respective drive bell cranks. Each heald frame attaches to more than one head of a flexible tie-rod, which in turn, extends down to adjustment sliders which are connected to the drive bell cranks. During the heald frame coupling and uncoupling from a locking apparatus at the head of the flexible tie-rod, two tilting jaws keep all of the flexible tie-rods in a rigid vertical position.

3 Claims, 4 Drawing Sheets

QUICK COUPLING SYSTEM FOR THE HEALD FRAMES OF A LOOM

FIELD OF INVENTION

The present invention relates to a simple, cheap and reliable quick coupling system which allows the heald frames of a loom to be easily and rapidly connected or disconnected to and from their respective drive lever, regardless of the length of the heald frame.

BACKGROUND OF THE INVENTION

As known in the weaving art, a warp yarn drive moves warp yarns in order to reverse the shed and thus accomplish the interweaving of fabric in a loom. The weaving of material in a loom is accomplished by means of a suitable plurality of heald frames having eyes through which the warp yarns run. The heald frames are hinged at their bottom ends and, if the frames are long, they are also hinged at their bottom middle portion to respective bell cranks, suitable for converting the movement of a dobby into the vertical reciprocating movement of the heald frames along their side vertical guides. Inasmuch as the motion transmitted by a bell crank takes place in an arcuate trajectory and therefore clearly cannot be perfectly vertical, like, the reciprocating movement of the heald frames along vertical guides, the hinging of the heald frame to its respective bell crank is accomplished through short connecting rods which make compensation possible for the rotation of the bell cranks.

According to the present state of the art, one end of each bell crank is hinged to a connecting rod and the opposite end is provided with an elastically-closing hook suitable for cooperating with a pivoting pin supported under the heald frame.

Unfortunately, the prior art has a very serious drawback in that hooking all connecting rods to their respective pivoting pins requires an extremely long time, is expensive and is very difficult. Hooking all the connecting rods requires an attending operator to maneuver in a very uncomfortable position under the loom, in order to cause the individual connecting rods to pivot until their hooking is accomplished.

In order to overcome this drawback, complex mechanisms have been provided which are suitable for simultaneously hooking and disengaging all of the connecting rods, as well as keeping them in their optimal position so the above operations may be performed. But these measures are of considerable structural complexity and are a great financial burden so as to prevent this solution from becoming successful at a commercial level.

SUMMARY OF THE INVENTION

The purpose of the present invention is to obviate the above drawbacks and therefore provide a quick coupling system which makes it possible for all the heald frames of the loom to be simultaneously coupled or disengaged easily, rapidly, and, above all, cheaply, to and from their respective bell cranks.

The above purpose is substantially accomplished by replacing the end coupling of each individual heald frame and its respective connecting rod, hinged at its bottom portion to a drive bell crank, with a lock coupling between said frame and a specific tie-rod. The compensation for the rotation of the bell cranks is accomplished by taking advantage of the flexibility of the tie-rods.

In other words, the system for rapidly coupling the heald frames of a loom to their respective drive bell cranks is characterized according to the present invention by a system comprising as many flexible tie-rods as bell cranks. The flexible tie-rods, which are hinged at their bottom portion to their respective drive bell cranks, are each provided, at their top end, with a top head suitable for interlocking inside a groove of a guide means which is provided with a stop or stroke limit shoulder and which is fastened onto the bottom side of the heald frames. The interlock coupling is secured over time by a position locking means. The flexible tie-rods are all kept, during the heald frame assembly or disassembly step, in a rigid, vertical position by two tilting jaws arranged at opposite sides relative to said tie-rods. The tilting jaws are rotated by a jaw actuator means.

In fact, with such a system, after all tie-rods are locked in a vertical position by means of said tilting jaws, the set of heald frames are slid onto the heads of the flexible tie-rods until they reach the stroke limit shoulders. After interlock-coupling the heald frames to their respective flexible tie-rods and said jaws are tilted to the reverse direction, the frames are ready to be vertically reciprocated because the rotation of the drive bell cranks is compensated for by the flexibility of the flexible tie-rods.

According to a preferred embodiment of the present invention, the means for locking the head of each individual flexible tie-rod in position inside the guide groove of the relevant heald frames consists of a ball, housed inside the guide means and urged by a spring towards said groove. The head is completely interlocked when it comes into contact with said stop or stroke limit shoulder. The ball then cooperates with an opposite hitch provided in said tie-rod head.

However, such an embodiment unavoidably causes a certain resistance when the tie-rods are entered into or disengaged from the grooves of said guides of the heald frames, such resistance being caused by the pressure exerted by each ball sliding on a head of said tie-rods, thus requiring a greater force to be applied in order to assemble or disassemble said frames. According to a variant of the present invention, which removes the drawback, said means for locking the head of each individual flexible tie-rod in its proper position, inside the grooves of the guide of the relevant heald frame, has a snap pawl. The snap pawl is hinged on the tie-rod head at the side farthest from said stop or stroke limit shoulder, and is urged by a spring, acting against its bottom portion, to enter a lock hollow provided in said guide means. The pawl is kept, during the heald frame assembly or disassembly steps, out from said hollow by the action of a protruding element extending from one of said jaws, which counteracts the action of said spring.

Such an embodiment, besides causing the heald frame assembly or disassembly to be easier, by keeping the pawls out from their lock hollows by the action of said protruding element extending from one of said jaws, it also secures, due to the particular position of said pawls and their springs, the flexible tie-rods in a vertical position. The flexible tie-rods, when said jaws are moved apart from each other, are kept urged against their respective stop or stroke limit shoulder by the action of an individually assigned spring which urges the bottom portion of the snap pawl against the protruding element of the jaw which is moved away.

Another preferred embodiment of the present invention is accomplished by having flexible tie-rods made with a rectangular cross-section, with the longer side approximately equal to the thickness of the heald frames and arranged perpendicularly to the heald frames, with the size of the shorter side being determined by the desired flexibility level.

As one can easily demonstrate, a flexible tie-rod is obtained which displays a resistance to the peak load which is applied at each heald frame lifting, which is approximately three times as high as compared to the resistance obtained from a circular-cross-section tie-rod having the same flexibility.

According to a further preferred embodiment of the present invention, said actuator means of the two tilting jaws consist of two gears. The gears, which are made integral with said jaw rotation shafts, are mutually in meshed, with one of the rotation shafts. The rotation shaft is furthermore integral with a lever which, in its turn, is hinged to one single actuator rod which actuates all used jaw pairs.

By horizontally pushing, the actuator rod in one direction, or in the opposite direction, the rotation of the jaws is urged from a closed position. This occurs during the heald frame assembly or disassembly steps, in order to keep said flexible tie-rods in a rigid, vertical position. An open, or tilted, jaw position, during the heald frame reciprocating step, enables the tie-rod to vertically move and bend.

The present invention is explained to a greater extent by referring to the accompanying drawings which illustrate preferred embodiments supplied for exemplification. Technical or structural modifications may always be supplied without limiting the scope of the present invention.

DESCRIPTION OF ILLUSTRATIVE EMBODIMENTS OF THE INVENTION

Figure 1:
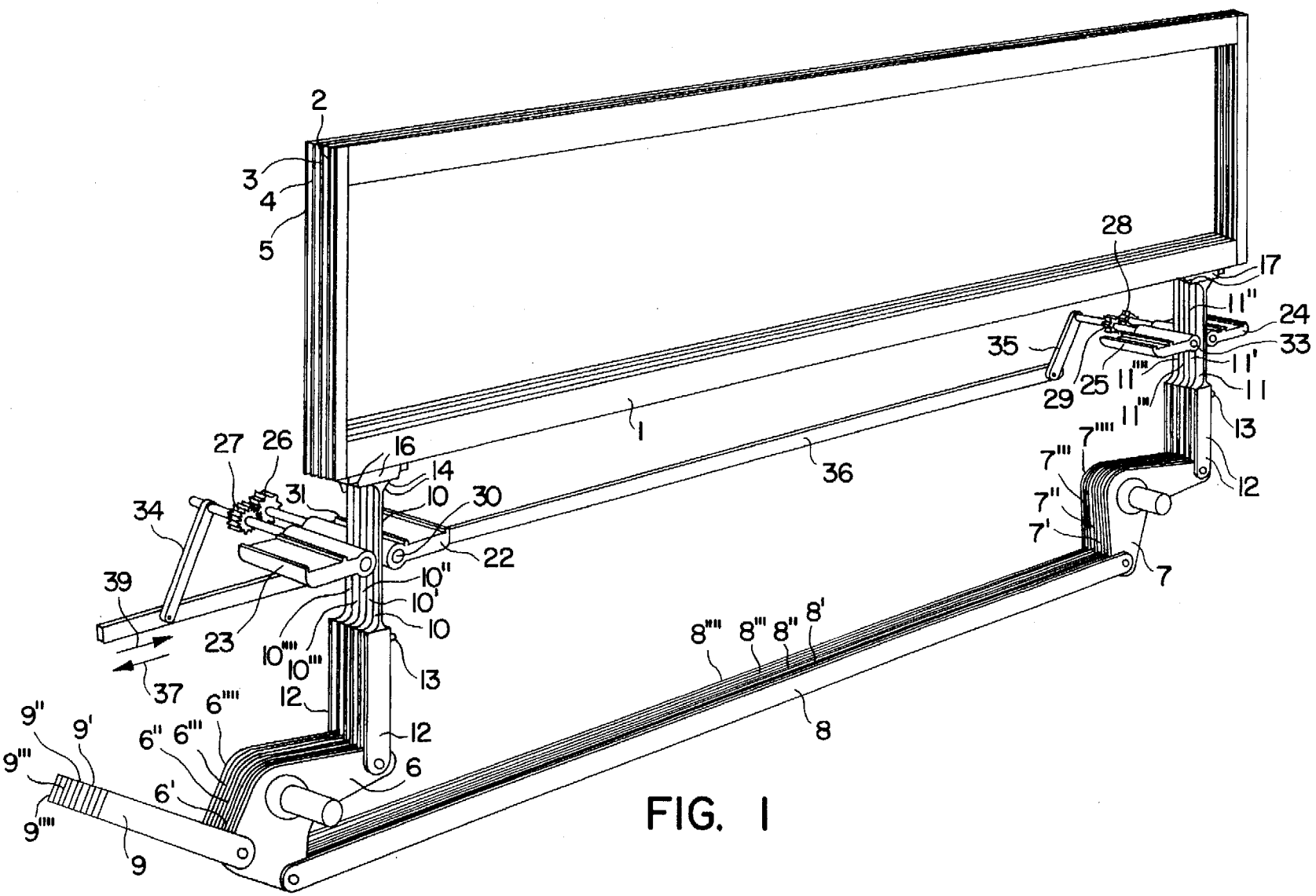
FIG. 1 shows a partial perspective view of the drive means for causing the heald frames to reciprocate, in which the fast coupling system according to the present invention is adopted.

Referring to FIG. 1, a plurality of heald frames 1, 2, 3, 4, 5 of a loom are displayed, which must be vertically reciprocated by at least two corresponding sets of bell cranks, respectively 6, 6', 6", 6'", 6"", and 7, 7', 7", 7'", 7"". A third set of bell cranks could be used at the middle point of the heald frames 1–5, in the case of very long frames. The bell cranks 6, 6', 6", 6'", 6"" and 7, 7', 7", 7'", 7"" are respectively connected with each other through the levers 8, 8', 8", 8'" and 8"", and are caused to reciprocate by a dobby, not displayed in the figures, through the connecting rods 9, 9', 9", 9'" and 9"".

The heald frames 1–5 are linked to their respective bell cranks 6—6"" and 7—7"" through fast coupling systems comprising a corresponding plurality of flexible tie-rods respectively indicated with 10, 10', 10", 10'", 10"" and 11, 11', 11", 11'", 11"". The flexible tie-rods 10—10"" and 11—11"" are hinged at their bottom end to the respective bell cranks 6—6"" and 7—7"" through adjustment sliders 12 which allow the height of said tie-rods to be adjusted just by acting on lock screws 13. The flexible tie-rods 10—10"" and 11—11"" are provided each, at their top end, with a head 14, see FIG. 2, which is suitable for entering, and becoming interlocked inside a longitudinal groove 15 of a guide means 16 or 17 which is provided with a stop or stroke limit shoulder 18, all of which is fastened to the bottom side of the heald frames 1–5. The set of guide means 16 or 17 are additionally provided with a hollow for housing a ball 19 which, urged by a spring 20 towards said groove 15, cooperates with the nitch 21 provided in the head 14 of each of the flexible tie-rods 10—10"" and 11—11"".

Figure 4:
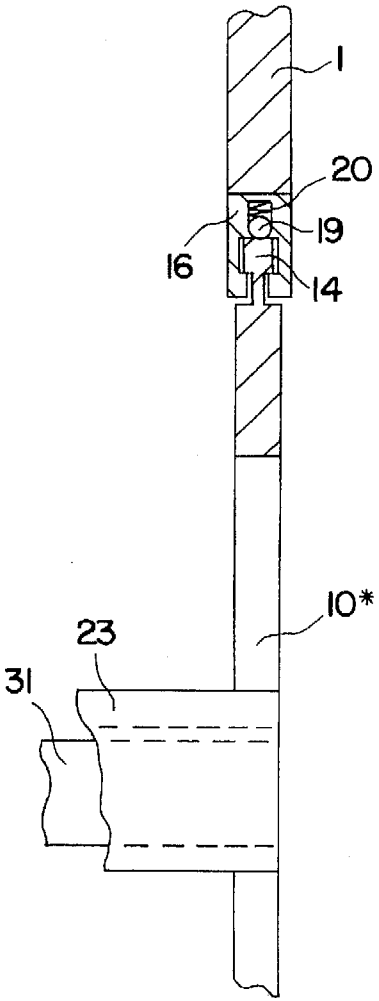
FIG. 4 shows a front sectional view made along line 4—4 of FIG. 3.

Furthermore, tie-rods 10—10"" and 11—11"" are made with a rectangular cross-section with its longer side 10*, see FIG. 4, having a thickness which approximately equals the thickness of the heald frames 1–5. Two tilting jaws 22, 23 and 24, 25 are installed opposite each other on the sets of tie-rods 10—10"" and 11—11"" and are caused to revolve from one closed position indicated by solid lines 22 and 23 in FIG. 2, to an open, or tilted, position, indicated in short dashed lines 22' and 23' in FIG. 2. The two sets of tilting jaws 22, 23 and 24, 25 operate by means of two gears, respectively 26, 27 and 28, 29 which are integral with the rotation shafts, respectively 30, 31 and 32, 33. The tilting jaws 22–25 are meshed together and revolve with said shafts 31 and 33, each being integral with levers of their own 34 and 35, respectively, both hinged to one single actuator rod 36.

Figure 2:
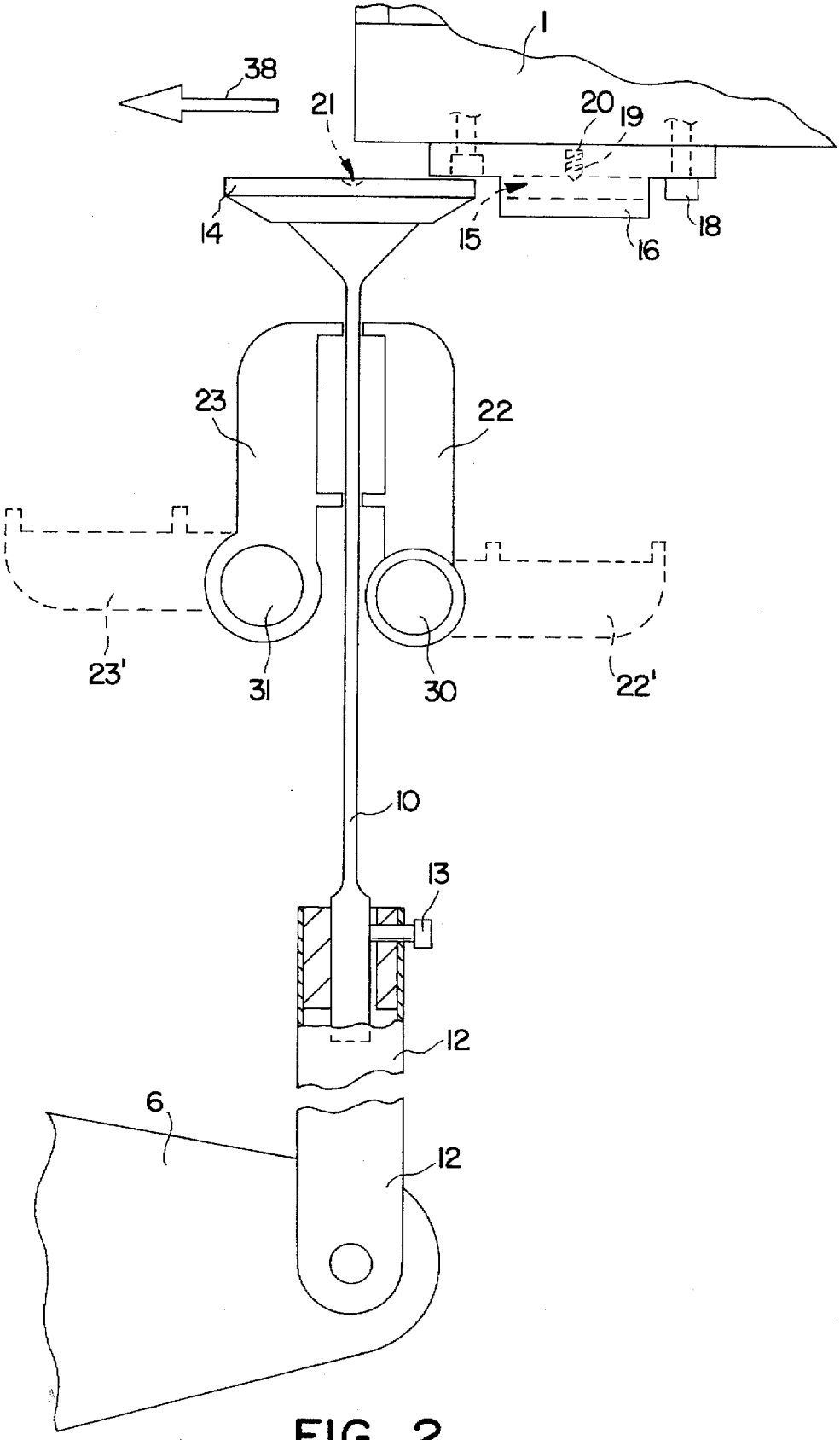
FIG. 2 displays a strongly magnified side view of the fast coupling system according to the present invention, during the step of assembly of one single heald frame.
Figure 3:
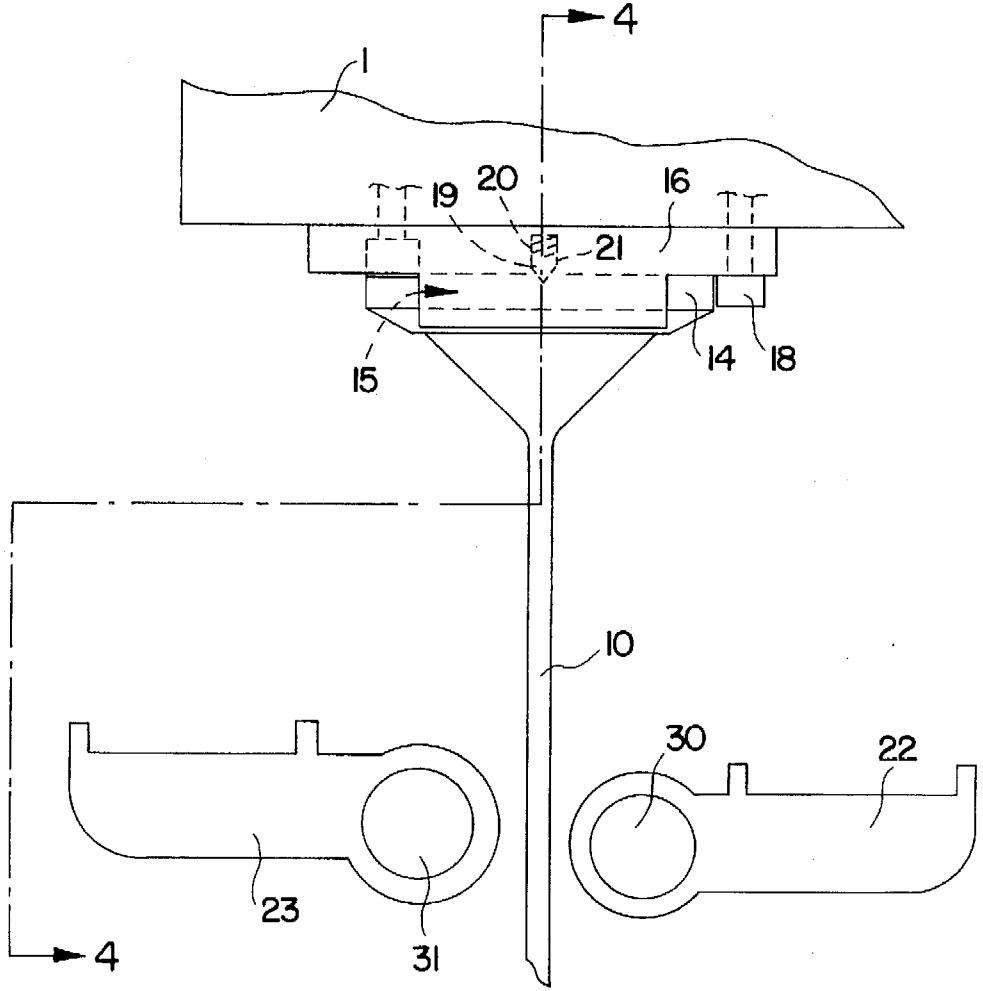
FIG. 3 displays a partial side view, on an enlarged scale, of FIG. 2, wherein the heald frame is already coupled.

The operation of the instant invention is as follows:

Starting from the position displayed in FIG. 1, the heald frames 1–5 are removed, and acting on the actuator rod 36 in the direction of arrow 37, the pairs of tilting jaws 22, 23 and 24, 25 are brought to their closed position, illustrated in FIG. 2, in order to keep the position of the flexible tie-rods 10—10"" and 11—11"" rigid and vertical. Now, the whole set of heald frames 1–5 are positioned to lie on the heads 14 of the tie-rods and heald frames 1–5 are slid in the direction of arrow 38 until the head 14, enters and becomes interlocked inside the longitudinal grooves 15, see FIG. 2, of the guide means 16 and 17 of said frames, and reach their stroke limit shoulders 18, as illustrated in FIG. 3. In that position, the heads 14 are locked by the cooperation between the balls 19 and the grooves 15 and thus the pairs of jaws 22, 23 and 24, 25 can be then tilted to their mutual position as displayed in FIG. 3, by moving the actuator rod 36 in the direction of arrow 39, see FIG. 1.

Figure 6:
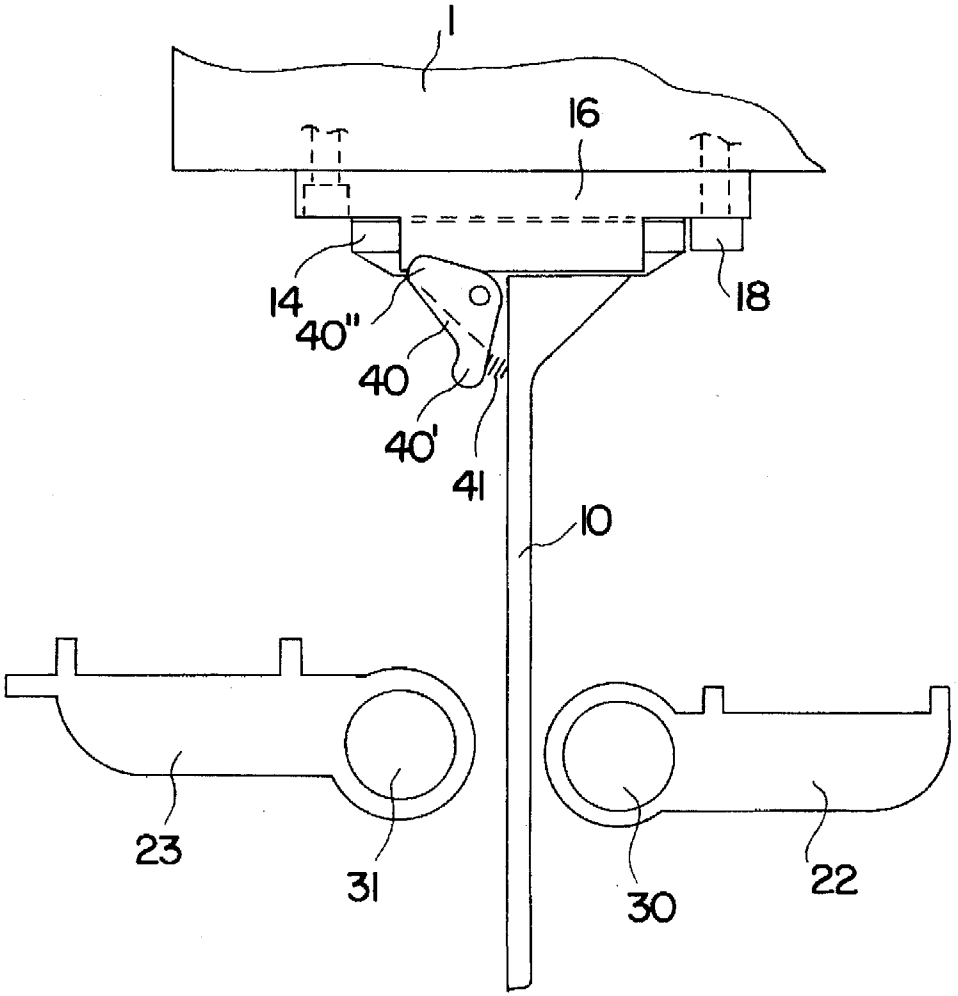
FIG. 6 shows a similar side view as FIG. 5, wherein the heald frame is already coupled.
Figure 5:
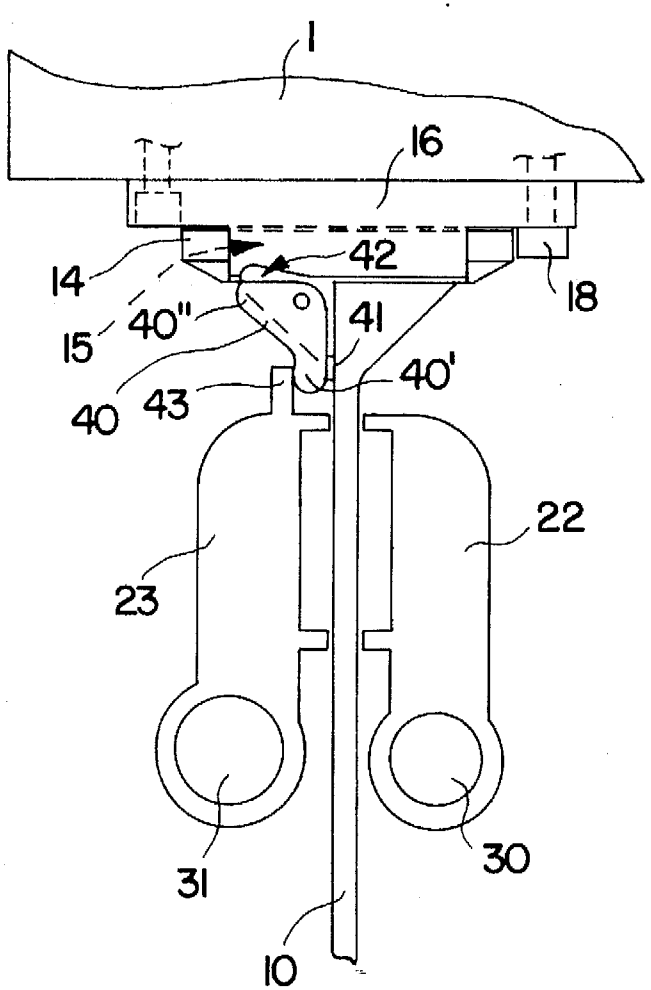
FIG. 5 shows a side elevation view of a variant of the invention, during the last step of assembly of a heald frame.

According to the different embodiment of the invention illustrated in FIG. 5 and 6, said tie-rod heads 14 are locked in their position inside the longitudinal grooves 15, by means of a snap pawl 40 which is hinged onto the portion of the tie-rod heads which is the farthest away from said stroke limit shoulder 18, i.e., substantially to the left of the flexible tie-rods 10—10"" and 11—11"", referring to FIG. 5 and 6. That snap pawl 40 is then urged at its bottom portion 40' by a spring 41 which pushes the upper side 40" thereof inside a lock hollow 42 provided in the guide slot 16. Furthermore, said lower portion 40' of said snap pawl 40 cooperates with a protruding element 43 extending from the underlying jaw 23 when the latter is in its closed position.

In that way, when the jaws 22, 23 reach their closed position, the protruding element 43 presses the spring 41 and keeps the snap pawl 40 out of the lock hollow 42 thus allowing an easier, smooth sliding of the heald frames 1–5 on the head 14 of the flexible tie-rods 10—10"" and 11—11"". On the other hand, as soon as the jaws 22 and 23 tilt to reach their open position as displayed in FIG. 6, the spring 41, by urging the bottom portion 40' of the snap pawl 40 against said protruding element 43, will ensure that the flexible tie-rod 10 always remains in the correct position, i.e., with its head 14 resting against the stop or stroke limit shoulder 18 until that position is secured by the upper portion 40" of pawl 40 entering said lock hollow 42.

We claim:

1. A system for rapid assembly and disassembly of heald frames to and from the drive bell cranks of a loom, comprising:

a plurality of flexible tie-rods having opposite ends, wherein one end of each of said tie-rods is hingedly connected to a bell crank and the other end has a head with a nitch therein, a guide on the bottom side of the heald frames for coupling and uncoupling the heald frames to and from said tie-rod heads by movement therebetween, wherein said guide has a stop for engaging said tie-rod heads to limit the coupling movement, a locking mechanism for said tie-rods having balls housed within said guide and springs within said guide, urging said balls from said guide until said tie-rods reach said stop during coupling, whereupon said balls engage said nitches in said tie-rods to interlock said tie-rods and the heald frames, and a pair of moveable jaws located on opposite sides of said tie-rods normally spaced therefrom and wherein said jaws are caused to rotate by an actuation means are movable into contact with said tie-rods to maintain said tie-rods in a vertical position when coupling and uncoupling occurs between said guide and said tie-rods, to thereby allow for the rapid assembly and disassembly of the heald frames and said tie-rods.

2. The system according to claim 1, wherein said flexible tie-rods have a rectangular cross-section, with the longer side approximately equal to the thickness of said heald frames and perpendicular to said frames, and the size of the shorter side is proportional to the desired degree of flexibility of said tie-rod.

3. The system according to claim 1 wherein said actuation means of said two tilting jaws comprises two gears wheels which are integral with rotation shafts of said jaws and are in meshed with each other, wherein one of said rotation shafts is integral with a lever which is hinged to one single actuator rod for all jaw pairs used.

* * * * *